United States Patent [19]

Small

[11] 4,233,764

[45] Nov. 18, 1980

[54] DEVICE FOR HANGING A PICTURE FRAME

[75] Inventor: Stuart R. Small, West Hartford, Conn.

[73] Assignee: The Colonial Spring Company, Bristol, Conn.

[21] Appl. No.: 971,192

[22] Filed: Dec. 20, 1978

[51] Int. Cl.[3] ..... G09F 1/12

[52] U.S. Cl. ..... 40/152.1; 248/489

[58] Field of Search ..... 40/152.1, 10 R, 11 R, 40/11 A; 248/489

[56] References Cited

U.S. PATENT DOCUMENTS

| | | | |
|---|---|---|---|
| 2,941,321 | 6/1960 | Wood | 40/10 R |
| 3,091,875 | 6/1963 | Crafa | 40/11 A |
| 3,668,799 | 6/1972 | Sharron | 40/152.1 |
| 3,922,807 | 12/1975 | Shore | 40/152.1 |

FOREIGN PATENT DOCUMENTS

| | | | |
|---|---|---|---|
| 420830 | 9/1967 | Switzerland | 40/11 A |

*Primary Examiner*—Gene Mancene
*Assistant Examiner*—Wenceslao J. Contreras
*Attorney, Agent, or Firm*—Barry Kramer

[57] ABSTRACT

An improved fastening device particularly adapted for hanging picture frames of the type provided with a channel section therein comprises an elongate, unitary element having intermediate portions thereof fashioned into a torsional spring which is inserted into the channel and grips portions of the latter without the need for anchoring screws. One extremity of the element extends longitudinally into the channel and abuts at least one sidewall thereof to prevent rotation of the device on the frame while the other extremity of the element projects out through an opening in the channel and has a hook member formed therein to allow attachment with a picture hanging wire.

5 Claims, 8 Drawing Figures

DEVICE FOR HANGING A PICTURE FRAME

FIELD OF THE INVENTION

This invention generally relates to picture frame constructions, and deals more particularly with an especially simple, cost effective device for fastening a wire or the like on the back of the frame to permit hanging the latter on a wall or other support.

BACKGROUND OF THE INVENTION

Many current designs of picture frame constructions now in widespread use employ picture holding frame members comprising relatively hard, thin walled materials such as aluminum or steel. These frame members may be manufactured by machining, molding or extrusion processes and normally include various longitudinal channels formed therein for receiving and holding a picture, a picture backing sheet and a glass cover sheet. Such frame constructions are well adapted to rapid user assembly by employment of L-shaped connecting pieces whose legs are received by respective channels in adjacent frame members and are secured in the latter by screws or other holding means. Picture frames of the type described above are disclosed in U.S. Pat. Nos. 2,581,843 and 3,922,807.

While the above mentioned picture frames are generally economical in construction, the fastening devices used in conjunction with such frames to allow hanging thereof on a wall or the like have in the past, as will be discussed in more detail later, been unduly complex and often comprise a two piece construction. For example, U.S. Pat. No. 3,922,807 discloses a fastening device comprising a looped handle secured to the frame by means of a threaded screw and metal strip which is disposed within a channel of the frame and functions to anchor the entire device thereat. U.S. Pat. No. 2,581,843 discloses a relatively simple, one piece picture hanging fastener clip which is also adapted to be secured within a channel section in the frame, however, this clip is not suitable for hanging heavier picture frames since such clip is subject to sliding within the channel section under heavy loading.

SUMMARY OF THE INVENTION

The present invention provides a highly economical, yet effective fastening device for use in hanging picture frames of the type provided with a channel section formed therein. An elongate element having looped portions forming coil turns therein provides a torsional spring adapted to be wedged between opposing sidewalls of the channel and hold the device securely in place on the frame. One extremity of the elongate element includes an extension which extends longitudinally into the channel and abuts at least one of the sidewalls of the latter to securely hold, and prevent rotation of the device within the channel, while the other extremity extends out of the channel and includes a hook member to which hanging wire or the like may be attached. A portion of one of the channel walls is interposed between the extremity of the device including the hook member and one of the coil turns, which exert a compressive force on such channel portion whereby to grip the latter and further secure the device on the frame. In an alternate embodiment of the invention, a leg member is provided integral with the longitudinal extension to abut the other sidewall of the channel and functions to prevent rotation of the device within the channel. Heavy loading imposed by larger picture frames on the device is torsionally transmitted to the extension and increases the force exerted by the latter against the channel, thereby assuring firm anchoring of the device to the frame.

DESCRIPTION OF THE DRAWINGS

While the specification concludes with claims particularly pointing out and distinctly claiming that which is regarded as the present invention, further details of a preferred embodiment of the invention may be more readily ascertained from the following detailed description when read in conjunction with the accompanying drawings wherein:

DETAILED DESCRIPTION OF THE INVENTION

Figure 1:
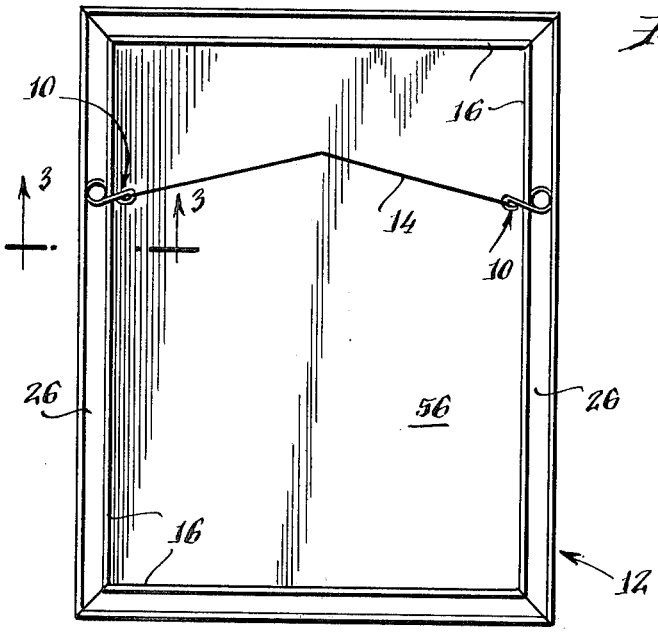
FIG. 1 is a rear elevational view of a picture frame employing the present invention.
Figure 3:
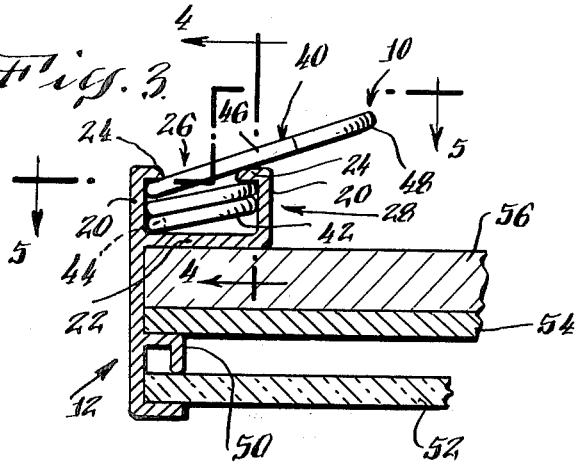
FIG. 3 is a sectional view taken along the line 3—3 in FIG. 1.
Figure 4:
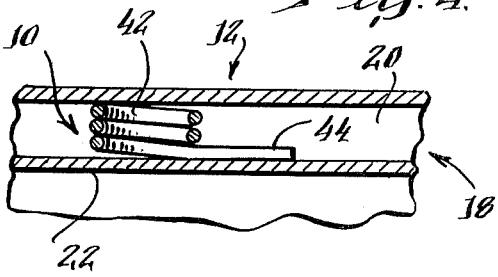
FIG. 4 is a sectional view taken along the line 4—4 in FIG. 3.

Turning attention now first to FIGS. 1 and 3, the invention is concerned with securing a fastening device 10 on opposite sides of a picture frame, generally indicated by the numeral 12, to allow suspension or hanging thereof on a wall or other support (not shown) by means of a wire 14 or the like trained between the fastening devices 10 and secured to each of the latter.

The picture frame 12 is of the type including a plurality of frame sections 16 each provided with a channel 18 formed integral therewith on the rear thereof. Channel 18 includes a pair of longitudinal, opposed parallel side walls 20 connected by a planar base side 22 extending coextensive therewith, and essentially perpendicular to, the sidewalls 20. Each of the sidewalls 20 include an inwardly turned, opposing flange 24 formed integral therewith, which flanges 24 extend essentially parallel with the base side 22 and define an access opening 26 therebetween. Sidewalls 20, base side 22, and flanges 24 form an open interior area having a generally rectangular shaped cross section, as best seen in FIG. 3, within which a major portion of the fastening device 10 is disposed.

Figure 2:
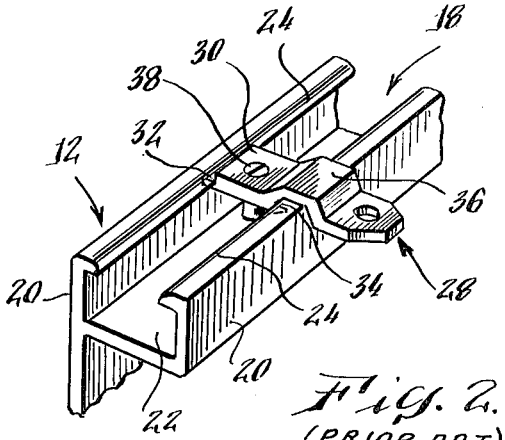
Fig. 2. (PRIOR ART)
FIG. 2 is a partial perspective view of a picture frame of the type depicted in FIG. 1, showing a typical prior art fastening clip secured thereon.

The full import and significance of the present invention can best be appreciated by a clear understanding of prior art fastening clips, consequently, reference is temporarily made now to FIG. 2 which depicts a typical prior art fastening device generally designated by the numeral 28, which is shown secured in its operative position within a channel 18 of the picture frame section 16. The prior art device 28 comprises an elongate clip 30 made of metal or the like, having a pair of grooves 32 and 34 machined therein, on opposite sides thereof, which are respectively adapted to complementally engage the flanges 24. An arcuately shaped portion 36 made by machining or bending the clip 30 accomodates the interior flange 24; flanges 24 and grooves 32 and 34 cooperate to slidably confine the clip 30 for longitudinal movement in the channel 18. Clip 30 is provided with a threaded aperture transversely therethrough which threadably receives a set screw 38. Tightening of the set screw 38 brings the latter into engagement with the base side 22 of the channel 18, thereby preventing sliding of the clip 30 in the channel 18. From the foregoing, it is apparent that the prior art device 28 is a two piece construction and includes a clip 30 which requires a number of processing steps (machining, drilling, forming, etc.) in the manufacture thereof which results in a relatively expensive fastening device in terms of the equipment and labor which is required to fabricate the same. As will become obvious below, the present invention significantly reduces manufacturing costs by providing a simple yet novel fastening clip design which eliminates costly machining, drilling and forming processes heretofore required to fabricate picture frame fastening clips.

Referring now to FIGS. 1 and 3–6, the invention involves a novel fastening clip device 10 fabricated from a unitary, elongate element 40 comprising a material such as spring steel. Intermediate portions of the element 40 have a looped section formed therein which comprises one or more helical coil turns 42 and from a torsional spring. In the preferred form, the cummulative spacing of the coil turns 42 will slightly exceed the distance between the inner surfaces of the flanges 24 and base side 22 of the channel 18. Each of the coil turns 42 are essentially coaxial with each other and will have a maximum outside diameter essentially the same as, or marginally smaller, than the distance between the inner surfaces of the sidewalls 20 of the channel 18, although in some forms of the device 10 it may be desirable to provide a diameter which is marginally larger than the latter mentioned distance for purposes which will become later apparent.

One extremity of the element 40 includes an extension in the nature of a straight leg 44 extending outwardly away from the coil turns 42 and lying essentially tangential to each of the latter. The opposite extremity of the element 40 includes an arm 46 also extending outwardly away from the coil turns 42 and lying essentially tangential to each of the latter. Arm 46 and straight leg 44 form an angle with respect to each other, which in the preferred form will be acute. Arm 46 includes a hook member 48 formed on the end thereof, distal from the coil turns 42, and forms combination with the latter mentioned member, a means for coupling the device 10 with the hanging wire 14. When removed from the channel section 18, arm 46, straight leg 44 and coil turns 42 lie in planes which are essentially parallel to each other.

Figure 5:
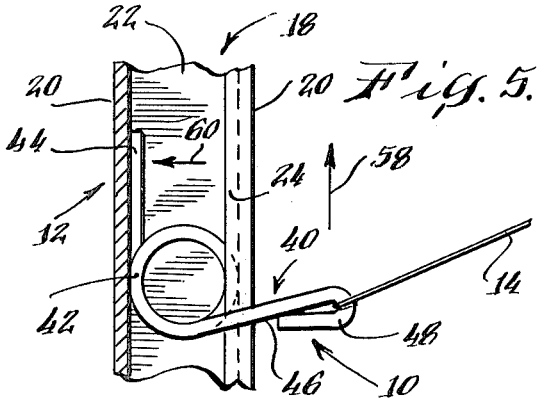
FIG. 5 is a sectional view taken along the line 5—5 in FIG. 3.

As previously indicated, the device 10 is particularly adapted to be employed with a picture frame of the type having frame sections 16 which include a channel 18. Frame section 16 will also typically include a second channel 50 having a lateral opening therein for holding a clear glass cover plate 52, which second channel 50 is transversely spaced from channel 18 to provide an opening therebetween within which the picture 54 and a planar backing support 56 may be retained. The device 10 is installed within the channel 18 prior to assembling the latter to form the frame 12. During installation, the device 10 is first positioned adjacent the opening defined by the sidewalls 20, base side 22 and flanges 20 in the end of the channel 18, with the straight leg 44 extending vertically upward (as best seen in FIG. 5) while the arm 46 is disposed inwardly toward the opposite side of the frame 12 and extending out of the interior channel area through the access opening 26. The device 10 is then wedgably inserted into and slid through the channel 18 to the desired longitudinal position along the latter. Element 40 is preferably fabricated in a manner that produces spacing between the coil turns 42 which is less than the thickness of the flanges 24 so that it becomes necessary to force portions of the interior flange 24 between one of the coil turns 42 and the arm 46, thereby forcing each of the latter apart from each other and causing the same to exert to compressive force on opposite sides of such interior flange 24 which grips the latter. Also, in the preferred form of the device 10, the number and longitudinal spacing of the coil turns 42 will be chosen such that it will be necessary to slightly compress portions thereof adjacent the outer sidewall 20, about the longitudinal axes of such coil turns 42, during insertion of the device 10 into the channel section 18; by this feature, the coil turns 42 exert a tension force on the interior surfaces of the outer flange 24 and the base side 22 to further anchor the device 10 in the channel 18. Finally, the diameter of the coil turns 42 may be chosen to marginally exceed the spacing between interior surface of the sidewalls 20, such that the sides of the coil turns must be wedged between the sidewalls 20 thereby further contributing to the griping action imposed by the coil turns 42 on the channel 18.

With the device 10 thusly installed in the channel 18 and securely held in place therein by the compressive spring forces described above, the frame sections 16 may then be assembled using the ordinary techniques to form the picture frame 12, and the hanging wire 14 may then be suitably secured to the hook member 48 of each of the devices 10 and trained therebetween to allow hanging of the frame 12 on a wall or other support. As shown in FIG. 5, with the frame 12 hanging on a wall, the tension force transmitted by wire 14 to the arm 46 through hook member 48 includes a vertical force component indicated by the arrow 58. This vertical force component produces a counterclockwise torque, as viewed in FIGS. 1 and 5, on the arm 46 which is transmitted by coil turns 42 to the straight leg 44 in the direction indicated by the arrow 60, thereby urging the latter to rotate into parallel abutting relationship with the outer sidewall 20. With the straight leg in abutment with the outer sidewall 20, the device 10 is precluded from further rotation and provides a firm stationary anchor for the hanging wire 14.

Figure 7:
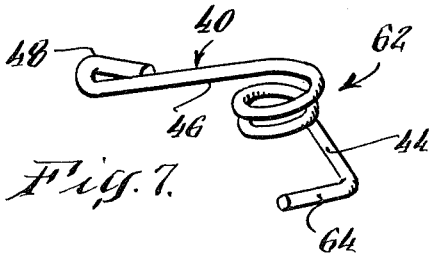
FIG. 7 is a perspective view of an alternate form of the fastening device, removed from a picture frame.
Figure 6:
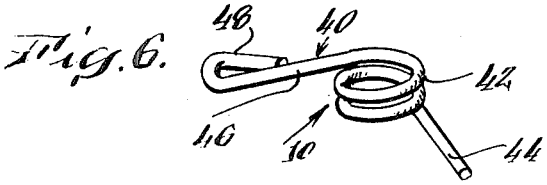
FIG. 6 is a perspective view of one form of the fastening device, removed from a picture frame, which forms the present invention.
Figure 8:
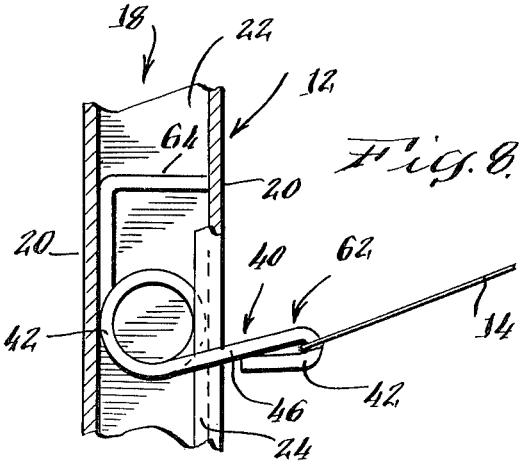
FIG. 8 is a fragmentary, longitudinal sectional view of a portion of a picture frame of the type depicted in FIG. 1, but showing the alternate form of the fastening device secured therein.

Attention is now directed to FIGS. 7 and 8 in which an alternate form of the device 62 is depicted which is essentially identical in construction to the device shown in FIG. 6 with the exception that a leg member 64 is provided integral with the straight leg 44 which extends angularly away from the latter, toward, and into engagement with, the inner sidewall 20. Leg 64 functions as a guide which aligns the device 62 during insertion thereof into the channel 18 and further functions to prevent rotation of the device 62 in a clockwise direction, as viewed in FIG. 8, when the latter has been installed.

From the foregoing, it can be appreciated that the present invention provides an effective yet highly economical fastening clip device for use in hanging picture frames. Although the preferred and alternate forms of the device have been described in detail herein, various modifications and equivalents thereof may be readily carried out without departing from the true gist and spirit of the subject matter which is claimed.

What is claimed is:

1. In combination with a picture frame of the type including a U-shaped channel section having a base side and a pair of opposing sidewalls extending away from said base side and terminating in a pair of inwardly turned flanges defining an opening therebetween, a device for hanging said frame on a wall or the like including:

an elongate element having a looped section formed in intermediate portions thereof interposed between said flanges and said base side of said channel section for retaining said device within the latter, one extremity of said element including a straight leg therein extending outwardly from said looped section and engaging one of said sidewalls of said channel section whereby to prevent rotation of said looped portion in one angular direction within said channel section, the opposite extremity of said element including means adapted for coupling with structure to hang said frame on said wall.

2. The combination of claim 1, wherein said straight leg of said element extends essentially tangentially away from said looped section, generally parallel to said one sidewall.

3. The combination of claim 2, wherein said one extremity of said element further includes a leg member extending angularly away from said straight leg thereof and engaging the other of said side walls of said channel section whereby to prevent rotation of said looped portion in the other angular direction within said channel section.

4. The combination of claim 2, wherein said looped section comprises a plurality of coaxial, helical coil turns, sections of certain of said turns being in force transmitting engagment with said flanges and said base side of said channel section, said coil turns being operable to deliver a force between said flanges and said base side whereby to securely hold said device within said channel section.

5. The combination of claim 4, wherein said coupling means extends outwardly away from said channel section through said opening in the latter and comprises a hook member.

* * * * *